United States Patent [19]

Urban et al.

[11] Patent Number: 4,810,858

[45] Date of Patent: Mar. 7, 1989

[54] FUSING ROLLER

[75] Inventors: Carl T. Urban, Hilton; Mark A. Lewis, Fairport; David A. Glocker, West Henrietta, all of N.Y.

[73] Assignee: Eastman Kodak Company, Rochester, N.Y.

[21] Appl. No.: 139,994

[22] Filed: Nov. 2, 1987

[51] Int. Cl.[4] ..... G03G 15/20

[52] U.S. Cl. ..... 219/469; 219/216; 355/3 FU

[58] Field of Search ..... 219/216, 469, 470, 471; 355/3 FU, 14 FU

[56] References Cited

U.S. PATENT DOCUMENTS

| | | | |
|---|---|---|---|
| 2,154,261 | 4/1939 | Brandt | 219/523 |
| 4,034,189 | 7/1977 | Sakamaki et al. | 219/216 |
| 4,109,135 | 8/1978 | Minden et al. | 219/216 |
| 4,395,109 | 7/1983 | Nakajima | 355/3 FU |
| 4,544,828 | 10/1985 | Shigenobu | 219/469 |
| 4,628,183 | 12/1986 | Satomura | 219/216 |
| 4,717,521 | 1/1988 | Border | 219/523 |
| 4,724,305 | 2/1988 | Iimura | 219/469 |

FOREIGN PATENT DOCUMENTS

| | | |
|---|---|---|
| 0240730 | 3/1987 | European Pat. Off. . |
| 0241714 | 3/1987 | European Pat. Off. . |

OTHER PUBLICATIONS

*Research Disclosure*, Jul. 1982, No. 21945, "Resistivity Heated Fuser Roller".

*Primary Examiner*—Teresa J. Walberg
*Attorney, Agent, or Firm*—Leonard W. Treash

[57] ABSTRACT

A fusing roller of the type having a thin resistance heating layer near its surface has a core made of a thermally and electrically insulative material, such as glass, which has a coefficient of thermal expansion comparable to that of the resistance heating layer. The roller can then withstand a high temperature curing process for other layers without separation of the resistance layer from the core.

5 Claims, 2 Drawing Sheets

FUSING ROLLER

RELATED APPLICATION

This application is related to co-assigned U.S. patent application Ser. No. 07/115,322, entitled ELECTRICAL CONTACTING DEVICE FOR FUSING ROLLER, filed concurrently herewith, in the name of Carl T. Urban.

TECHNICAL FIELD

This invention relates to electrostatography, and more particularly to a fusing roller for heated roller fusing.

BACKGROUND ART

U.S. Pat. No. 4,395,109 describes a roller fusing mechanism for fusing toner to paper or another substrate in which a thin resistive heating layer is positioned close to the surface of a heated roller. This structure permits rapid and efficient transfer of heat to the surface of the roller. Consequently the surface temperature of the roller can be controlled more accurately, and less power is required to heat the roller surface.

This prior roller includes a core constructed of a metal, ceramic, or other material, onto which heat insulating and electrical insulating layers are applied. The electrical insulating layer acts as the support layer for the resistive heating layer. After the resistive heating layer is applied to the electrical insulating layer it is coated with an outer protective layer. This layer provides the fusing surface. Electrical contact between the resistive heating layer and power source is established by conductive rings and electrical brushes located at each end of the roller. Heating of the roller is established by continued current flow.

Rapid and efficient heat transfer to the fusing surface of the roller can be achieved by this structure, but its complex design requires many interfaces between layers. If the outer protective layer is made of a material requiring high temperature heat curing, for example, a fluorinated hydrocarbon, the high temperatures necessary for this process may cause separation at one of the layer interfaces, thus damaging the fusing roller.

DISCLOSURE OF THE INVENTION

It is the object of the invention to provide a fusing roller for electrostatographic apparatus generally of the type having a core, a resistance heating layer, and an outer protective layer, but which withstands high temperatures without layer separation.

This and other objects are accomplished by a core that is both electrically and thermally insulative upon which the resistive heating layer is directly applied.

According to a preferred embodiment the core is a material having a coefficient of thermal expansion that is similar to that of the resistive heating layer. A preferred core material is glass.

According to a further preferred embodiment, the resistive heating layer is a thin, for example, between 0.1 and 0.3 microns thick, layer of metal or metal alloy, for example, an alloy including approximately 29% nickel and 71% iron, and the core is an alkali barium borosilicate glass.

The outer protective layer may be of any well known abhesive, durable material such as silicone rubber or any one of the fluorinated hydrocarbons. However, the invention has its best application when the material used for the protective layer requires high temperature curing.

BEST MODE OF CARRYING OUT THE INVENTION

Figure 1:
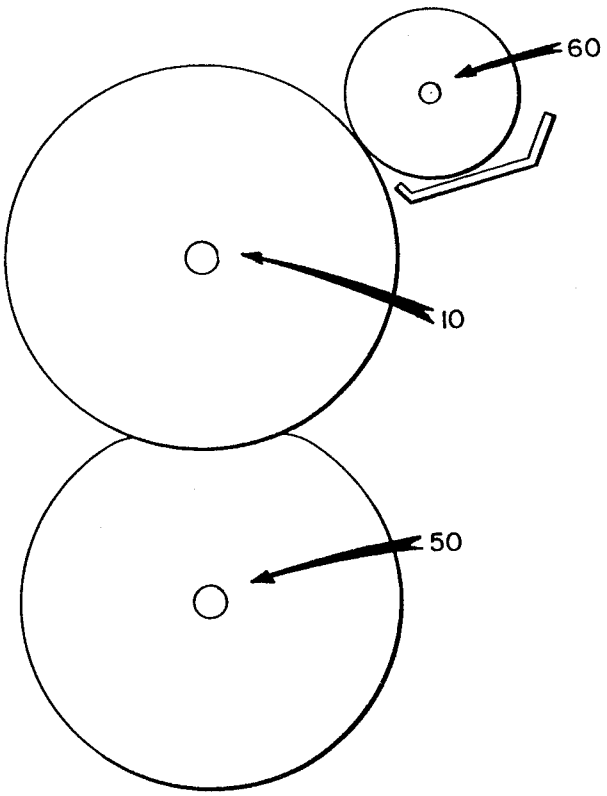
FIG. 1 is a schematic side view of a fusing apparatus using the fusing roller of FIG. 2.

According to FIG. 1 a fusing roller 10 is part of a fusing mechanism of a type well known in the art. The fusing mechanism includes a pressure roller 50 for providing a heating nip and a wicking mechanism 60 for applying release oil to prevent toner offset onto the fusing roller.

Figure 2:
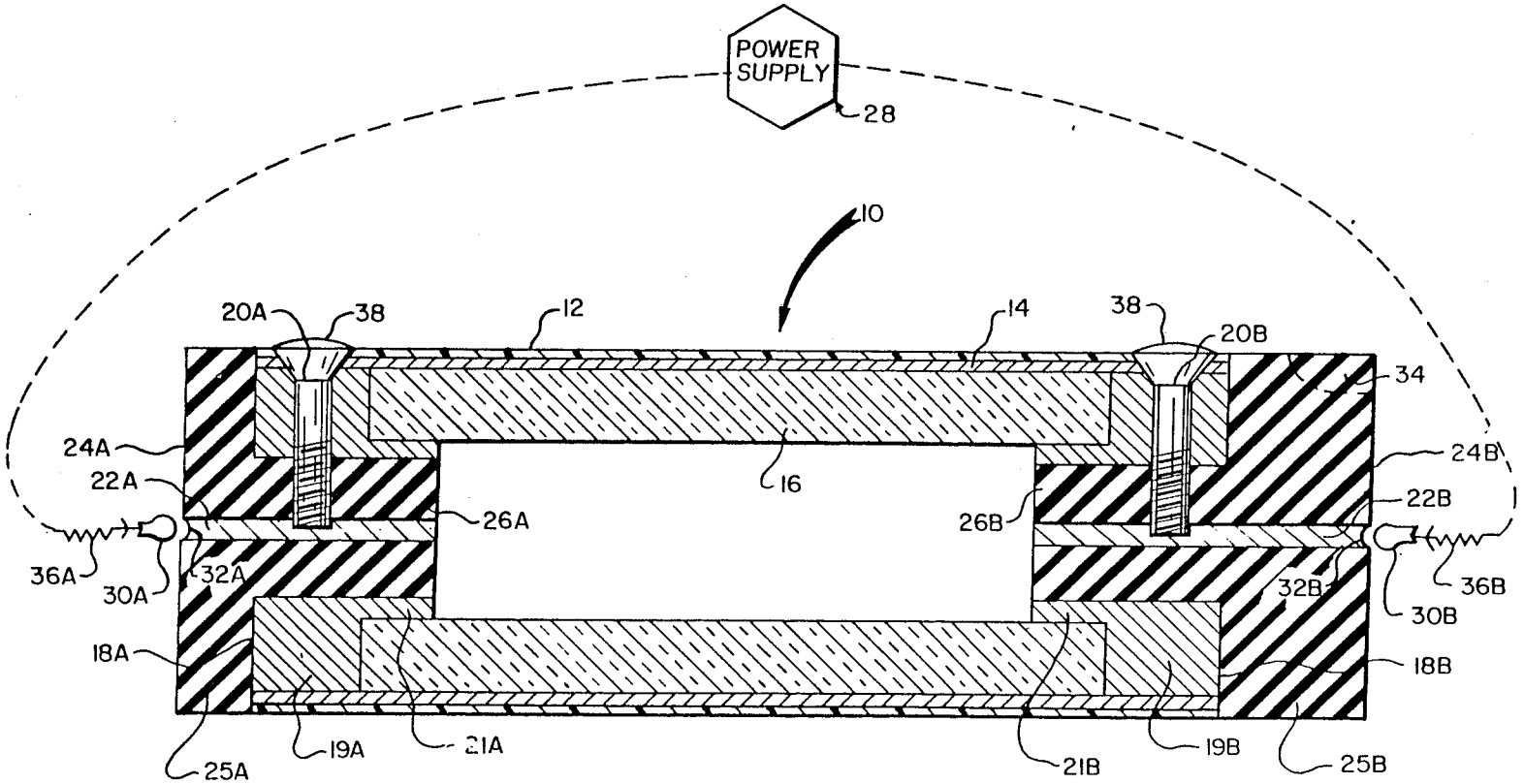
FIG. 2 is a side section of a fusing roller constructed according to the invention.

According to FIG. 2 the fusing roller 10 comprises a core 16, a resistive heating layer 14, and a protective layer 12 serving as the fusing surface. The resistive heating layer is positioned between the core and the protective layer. To limit heat loss and electrical shorting at the core 16 of the fusing roller, the core 16 is both thermally and electrically insulative, for example, the entire core is composed of glass.

Resistive heating layer 14 is electrically connected to a power supply 28 through an electrical contacting structure. This structure provides thorough contact which allows electrical current to be evenly distributed to the resistive heating layer 14. This electrical contacting structure includes conductive annular elements, such as rings 18A and 18B, which provide broad area contact with layer 14. Conductive annular elements 18A and 18B adjoin core 16 and comprise sections 19A and 19B with outside diameters corresponding to the outside diameter of the insulative surface on core 16, and annular extensions 21A and 21B with outside diameters corresponding to the inside diameter of the core 16. Conductive cylindrical elements such as plugs 22A and 22B, are positioned at the axis of fusing roller 10 and are connected to conductive rings 18A and 18B by connecting means, for example, screws 20A and 20B. The heads of screws 20A and 20B are covered with a protective material 38 to decrease release oil damage and provide insulation.

Insulative annular elements 24A and 24B, for example rings made from a phenolic material, support conductive plugs 22A and 22B and protect the roller ends and the conductive rings 18A and 18B from heat loss and release oil damage. Insulative rings 24A and 24B comprise sections 25A and 25B having outside diameters which correspond to the outside diameter of the fusing roller 10, and annular extensions 26A and 26B whose outside diameters correspond to the inside diameter of the conductive rings 18A and 18B.

The electrical current needed to heat the resistive heating layer 14 is supplied by the power supply 28. Electrical contact between the power supply 28 and the conductive plugs 22A and 22B can be accomplished by any known axial connecting mechanism. A preferred design is shown in FIG. 2 and includes ball conductors 30A and 30B which are urged by springs 36A and 36B into relative, sliding rotational movement with hemispherical cavities 32A and 32B in the ends of conductive plugs 22A and 22B.

In operation, electrical current provided by the connected power supply 28 flows through ball conductors 30A and 30B, conductive end plugs 22A and 22B, screws 20A and 20B, conductive rings 18A and 18B, and resistive heating layer 14. The resistive heating layer materials, in response to the electrical current flow, produce the desired heating effect of the fusing roller 10. The insulative core 16 and insulative rings 24A and 24B minimize heat loss within the system.

The internal electrical contacting structure shown in FIGS. 1 and 2 is almost entirely insulated and protected from the release oil and the operating environment. Therefore, the problems of element corrosion, electrical contact degradation and fusing roller damage due to release oil are decreased. The possibilities for mechanical and electrical malfunctions are decreased because the majority of the contacting structure is housed within the fusing roller. Improved electrical contact is maintained because the axially located conductors connecting the power supply 28 to the conductive end plugs 22A and 22B are positioned at each end of the fusing roller and consequently, less exposed to the release oil. In addition, the required operating space is reduced.

Electrical continuity of the resistive heating layer 14 maintains uniformity of the heat applied to the surface to be fused. Damage to the resistive heating layer, such as cracking, will occur if the resistive heating layer becomes separated from the core during manufacture or use. Fusing roller materials having dissimilar thermal expansion coefficients will experience varying amounts of expansion when heated during manufacture or use, thus increasing the possibility of resistive heating layer and core separation. For example, the curing process in applying the outer protective layer 12 may require a high temperature which invites such separation. Therefore, materials used for the resistive heating layer and core should exhibit excellent bonding characteristics and have similar coefficients of thermal expansion.

Many metallic or metallic alloy resistive layer materials which have resistive properties particularly useful in this type of fusing roller when applied as thin layers, have a coefficient of thermal expansion between $30\times10^{-7}$ to $120\times10^{-7}$ linear distance per distance per degree C. Most glass compositions also fall in this range. Thus, glass is an excellent material to be used for the core. One or more glasses can be matched with each resistive material in this respect.

The preferred embodiment shown in the FIGS. includes an abhesive outer protective layer 12 which requires high curing temperatures, for example, polytetrafluoroethylene, and a resistive heating layer, 0.1 to 0.3 microns thick, made from a metal alloy of about 29% nickel and 71% iron. Because of a close match in thermal expansion properties, this alloy maintains excellent bonding with a core made of an alkali barium borosilicate glass. However, many other usable materials also bond well with the same or other glasses. For example, a tungsten resistive heating layer matches well with a borosilicate, soda borosilicate, or soda lime borosilicate glass core. Titanium resistive heating layers are applied to potash soda lime or alkali barium glass cores, and tantalum resistive heating layers are used with lead borosilicate, soda zirconia, or soda borosilicate glass cores. Resistive heating layers made of certain carbon steels are applied to glass cores made of potash soda lime, or potash lead. Stainless steels containing 17% and 28% chromium are applied to glass cores made of potash lead, alkali barium, or soda potash lead. A metal alloy containing approximately 42% nickel, 6% chromium, and 52% iron is applied to glass cores made from potash soda lead, soda lime, potash lead, lead zinc borosilicate, alkali barium, alkali lead, or soda barium fluoride. Glass cores made of alkali barium borosilicate, alkali borosilicate, soda borosilicate, borosilicate, aluminosilicate, alkali earth aluminosilicate also maintain the desired bonding and thermal expansion properties when coated with a resistive heating layer made of molybdenum. These cores also bond well with metal alloys containing approximately (1) 29% nickel and 71% iron, (2) 40.5–41.75% nickel-cobalt and 59.5–58.25% iron, and (3) 17% cobalt and 83% iron.

The thickness of the resistive heating layer is dependent on the composition of the material used, and the amount of available power. For example, when the resistive heating layer 14 is made of the preferred nickel-iron alloy its thickness can range from 0.1 microns to 0.3 microns.

The protective layer 12 includes at least one material that provides good toner release properties, for example, silicone rubber or polytetrafluoroethylene, as is well known in the art. For example, a protective layer of polytetrafluoroethylene having a thickness ranging from 1.0 mils to 2.0 mils including any primer layer gives good results when coated directly on the preferred nickel-iron alloy resistive heating layer previously coated on an alkali barium borosilicate glass core.

Manufacture of the described fusing roller includes completely inserting annular extensions 21A and 21B of conductive rings 18A and 18B into each end of core 16. The outside surfaces of sections 19A and 19B of conductive rings 18A and 18B form a continuous surface with the outside surface of the core 16. The method for joining these components is dependent on the types of materials used. For example, thermal properties of a glass core and conductive rings made of a nickel-iron alloy are similar; therefore, permanent contact between the core 16 and conductive rings 18A and 18B can be established by means such as welding.

The resistive heating layer 14 is then applied as a coating to the continuous surface formed by the core 16 and attached conductive rings 18A and 18B. For example, the high precision resistance heating layer described above can be produced by a magnetron sputtering process well known in the art. A magnetron is specifically designed to produce uniform deposition flux of coating material around a substrate circumference. The deposition conditions, i.e., discharge power, vacuum pressure, and substrate bias level and temperature are controlled to produce resistive films with specific thermal expansion coefficients, temperature coefficients of resistivity and substrate adhesion.

Once the desired resistive heating layer thickness is obtained, the outside surface of the resistive heating layer 14 is cleaned, for example, by chemical etching. Bonding strength between the resistive heating layer 14 and the protective layer 12 is further increased by this cleaning process. The protective layer 12 is then applied over the entire exposed surface of the resistive heating layer 14. For example, if a polytetrafluoroethylene protective layer is to be added, a primer layer is applied to a thickness of 0.3 to 0.4 mils and dried at 450 degrees F. for 15 minutes. The polytetrafluoroethylene (PTFE) layer is then applied to a thickness of 0.5 to 1.5 mils and cured for 30 minutes at 725 degrees F. Rollers can be cured at this high temperature without causing separation between the resistance layer and the glass substrate constructed according to the invention.

Annular sections 26A and 26B of insulative rings 24A and 24B are then completely inserted into the centers of conductive rings 18A and 18B respectively. The continuous outside surface of the fusing roller is maintained by the outside surfaces of sections 25A and 25B of insulative rings 24A and 24B. Section 25B of ring 24B has a larger axial width than section 25A of ring 24A in order to accommodate means for driving the fusing roller, such as slot 34 in which a drive gear is mounted. Conductive end plugs 22A and 22B are then inserted into the centers of the insulative rings 24A and 24B, extending into the portions 26A and 26B to provide additional support to the fusing roller 10.

Electrical contact between the conductive end plugs 22A and 22B and the conductive rings 18A and 18B is established by inserting conductive means such as screws 20A and 20B into the ends of the fusing roller 10 from the outer surface of said roller toward the axis of the core 16. These screws 20A and 20B pass through and contact the resistive heating layer 14, conductive rings 18A and 18B, insulative rings 24A and 24B, and extend into the conductive end plugs 22A and 22B respectively. The exposed heads of screws 20A and 20B are protected from the operating environment by a coating 38, such as silicone rubber.

After the means for driving the fusing roller, such as a drive gear is attached to the insulating ring 24B by means of slot 34, the completed fusing roller 10 is mounted into an electrophotographic machine by conventional mounting means and connected to the power supply by snapping the spring mounted ball conductors 30A and 30B into the hemispherical cavities 32A and 32B, located on the ends of the conductive end plugs 22A and 22B.

The invention has been described in detail with particular reference to a preferred embodiment thereof, but it will be understood that variations and modifications can be effected within the spirit and scope of the invention as described hereinabove and as defined in the appended claims.

We claim:

1. A fusing roller for electrostatographic apparatus, said roller being of the type having a core, a resistive heating layer connectable to an electrical power supply, and an outer protective layer, characterized in that the core and resistive heating layer are distinct layers which directly adjoin each other, said core is constructed of a thermally and electrically insulative glass and said resistive heating layer is a thin layer of conductive material coated on said core, and said core and resistive heating layer consist of materials with similar coefficients of thermal expansion ranging from $30\times10^{-7}$ to $120\times10^{-7}$ linear distance per distance per degree C.

2. The fusing roller according to claim 1 characterized in that the resistive heating layer comprises a metal or metal alloy having a thickness between 0.1 microns and 0.3 microns.

3. The fusing roller according to claim 2 further characterized in that the resistive heating layer comprises a metal alloy including 29% nickel and 71% iron and the core is an alkali barium borosilicate glass.

4. The fusing roller according to claim 1 characterized in that the protective layer has an abhesive surface.

5. The fusing roller according to claim 4 further characterized in that the protective layer is polytetrafluoroethylene.

* * * * *